US007637039B2

(12) United States Patent
Toda et al.

(10) Patent No.: US 7,637,039 B2
(45) Date of Patent: Dec. 29, 2009

(54) METHOD AND APPARATUS FOR CONTROLLING HYDRAULIC PUMP FOR WORKING MACHINE OF WORKING VEHICLE

(75) Inventors: Eiji Toda, Hatoyama-Cho (JP); Yoshiharu Sato, Mooka (JP)

(73) Assignee: Komatsu Ltd., Tokyo (JP)

( * ) Notice: Subject to any disclaimer, the term of this patent is extended or adjusted under 35 U.S.C. 154(b) by 610 days.

(21) Appl. No.: 10/529,821

(22) PCT Filed: Oct. 14, 2003

(86) PCT No.: PCT/JP03/13125

§ 371 (c)(1),
(2), (4) Date: Aug. 23, 2005

(87) PCT Pub. No.: WO2004/038232

PCT Pub. Date: May 6, 2004

(65) Prior Publication Data

US 2006/0099081 A1 May 11, 2006

(30) Foreign Application Priority Data

Oct. 23, 2002 (JP) ..... 2002-307834
Jan. 30, 2003 (JP) ..... 2003-022319
Aug. 21, 2003 (JP) ..... 2003-297034

(51) Int. Cl.
*E02F 5/02* (2006.01)

(52) U.S. Cl. ..... 37/348; 60/446; 37/195

(58) Field of Classification Search ..... 37/348, 37/382, 414, 195, 902; 172/1, 2, 3, 10; 60/445, 60/446, 459, 422, 327; 417/1, 212, 213
See application file for complete search history.

(56) References Cited

U.S. PATENT DOCUMENTS 3,754,400 A * 8/1973 Parquet ..... 60/445

(Continued)

FOREIGN PATENT DOCUMENTS

DE 38 23 283 C2 9/1992

(Continued)

OTHER PUBLICATIONS

A Spanish Search Report dated Apr. 1, 2008, issued in a counterpart Spanish Application.

*Primary Examiner*—Thomas B Will
*Assistant Examiner*—Jamie L McGowan
(74) *Attorney, Agent, or Firm*—Frishauf, Holtz, Goodman & Chick, P.C.

(57) ABSTRACT

A hydraulic pump displacement control apparatus for a working vehicle capable of reliably detecting the working vehicle under excavating operation and reducing loss in power is provided. For this purpose, the control apparatus includes a bottom pressure detector (45) for detecting a hydraulic pressure in a bottom side (13A) of a cylinder (60) for operating a working machine (10), a displacement control device (41) for controlling a displacement of a variable displacement hydraulic pump (26), and a controller (50) which determines that an excavating operation starts when a predetermined time elapses with a detection value from the bottom pressure detector at a predetermined value or less and thereafter, the detection value exceeds the predetermined value, and outputs a displacement control signal to reduce the displacement of the hydraulic pump to a predetermined displacement that is smaller than the maximum displacement to the displacement control device.

13 Claims, 12 Drawing Sheets

U.S. PATENT DOCUMENTS

| | | | | | |
|---|---|---|---|---|---|
| 4,277,898 | A | * | 7/1981 | Flippin | 37/348 |
| 4,886,422 | A | | 12/1989 | Takeuchi et al. | |
| 4,930,992 | A | | 6/1990 | Takeuchi et al. | |
| 4,932,840 | A | | 6/1990 | Takeuchi et al. | |
| 5,490,384 | A | * | 2/1996 | Lunzman | 60/327 |
| 5,525,043 | A | * | 6/1996 | Lukich | 417/218 |
| 5,964,090 | A | * | 10/1999 | Nam et al. | 60/422 |
| 6,073,442 | A | | 6/2000 | Creger et al. | |
| 6,312,209 | B1 | * | 11/2001 | Duell et al. | 414/408 |
| 2003/0154091 | A1 | * | 8/2003 | Adachi et al. | 705/1 |

FOREIGN PATENT DOCUMENTS

| | | | | |
|---|---|---|---|---|
| DE | 42 29 950 | C2 | | 3/1994 |
| EP | 0 462 589 | B1 | | 4/1995 |
| JP | 62-160334 | A | | 7/1987 |
| JP | 62-220620 | A | | 9/1987 |
| JP | 62-291335 | A | | 12/1987 |
| JP | 07-139511 | A | | 5/1995 |
| JP | 09-060047 | A | | 3/1997 |
| JP | 09060047 | A | * | 3/1997 |
| JP | 10-212740 | A | | 8/1998 |
| JP | 2003-184134 | A | | 7/2003 |

* cited by examiner

METHOD AND APPARATUS FOR CONTROLLING HYDRAULIC PUMP FOR WORKING MACHINE OF WORKING VEHICLE

This application is a U.S. National Phase Application under 35 USC 371 of International Application PCT/JP03/13125 filed Oct. 14, 2003.

TECHNICAL FIELD

The present invention relates to a method and apparatus for controlling a displacement of a hydraulic pump for a working machine of a working vehicle, particularly, a vehicle for construction work.

BACKGROUND ART

For example, in a hydraulic system for driving a working machine of a wheel loader which is a vehicle for construction work, there is the case where a hydraulic pressure is required, but only a small discharge amount is required at the time of an excavating operation or the like. If a fixed displacement type hydraulic pump is used in such a case, a large amount of pressure oil is returned into a tank, and large power loss is caused. In order to reduce the power loss, there is provided a method of reducing a pump discharge amount at the time of an excavating operation by using a variable displacement type hydraulic pump. As one example of this, there is the one disclosed in the U.S. Pat. No. 6,073,442. According to this, the method is for controlling the pump displacement to reduce to a predetermined displacement of the maximum displacement or less by determining that the working vehicle is under excavating operation when at least one of the following conditions is satisfied: i) the transmission is in the forward and first speed gear position, ii) the working machine is in the excavating position and iii) the vehicle traveling speed is at the set speed or lower.

Among the above described conditions, the excavating position of the working machine is specified as shown in FIG. 13. FIG. 13 is a side view of a working machine 70 in the excavating position. A base end portion of a lift arm 72 is swingably attached to a vehicle body 71 with an arm pin 73, and the vehicle body 71 and the lift arm 72 are connected by a lift cylinder 74. When the lift cylinder 74 is extended or contracted, the lift arm 72 swings around the arm pin 73. A bucket 75 is swingably attached to a tip end portion of the lift arm 72 with a bucket pin 76, and the vehicle body 71 and the bucket 75 are connected via a tilt cylinder 77 and a link device 78. When the tilt cylinder 77 is extended or contracted, the bucket 75 swings around the bucket pin 76. As for the excavating position of the working machine 70, the line Y to Y which connects the arm pin 73 and the bucket pin 76 is set as the reference, and the case where the lift arm 72 is located below the line Y-Y is defined as being in the excavating position.

However, in the above described method, the following problems exist. First, when the transmission is in the forward and first speed gear, the pump capacity is reduced to a predetermined displacement which is the maximum displacement or less. However, in this case, excavating operation is not always performed, but the working vehicle is approaching a predetermined place while operating the working machine with the forward and first speed gear in some cases. In such a case, the speed of the working machine becomes slow, and the working efficiency sometimes reduces. Depending on the soil property, an operation is sometimes performed with the forward and second speed gear, on which occasion, the pump displacement is not reduced and therefore, power loss occurs.

Secondarily, when the vehicle traveling speed is a set speed or lower, the pump displacement is reduced to a predetermined displacement which is the maximum displacement or less. However, there is the case where the working vehicle moves to a destination at the set speed or lower while operating the working machine without performing an excavating operation. In such a case, the pump capacity is also reduced, and the speed of the working machine becomes low, which lowers the working efficiency in some cases. Thirdly, when the transmission is in the forward and first speed gear, the working machine is in the excavating position and the vehicle traveling speed is the set speed or lower, the pump displacement is reduced to the predetermined displacement which is the maximum displacement or less. At the time of ordinary excavation, the bucket is slightly lifted from the ground to prevent the bucket from contacting the ground and increasing the traveling resistance until it comes just in front of the target object, and the bucket is quickly brought into contact with the ground just before it thrusts into the target object. In this case, the response speed of the working machine becomes low, and there arises the problem that the operation slows down and the operator feels incompatibility.

DISCLOSURE OF THE INVENTION

The present invention is made in view of the above described problems, and has its object to provide a method and an apparatus for controlling a hydraulic pump for a working machine of a working vehicle, which reduces pump displacement after reliably detecting that the working vehicle is under excavating operation and reduces loss in power, and which does not reduce operation efficiency or does not give a sense of incompatibility to an operator.

In order to attain the above described object, a method for controlling a hydraulic pump for a working machine of a working vehicle according to the present invention is: in a method for controlling a hydraulic pump for a working machine of the working vehicle having a cylinder for operating the working machine and the hydraulic pump for supplying predetermined pressure oil to the cylinder, including the steps of; measuring a duration time of a state in which a hydraulic pressure in a bottom side of at least one cylinder of the cylinder is at a predetermined value or less; determining that an excavating operation starts when a predetermined duration time elapses and thereafter, the hydraulic pressure in the bottom side exceeds the predetermined value; setting a displacement of the hydraulic pump at a predetermined displacement reduced to be smaller than a maximum displacement; and performing a control to reduce the displacement of the hydraulic pump to the predetermined displacement.

According to the above method, it is determined that the excavating operation starts when the hydraulic pressure in the bottom side of the cylinder is at the predetermined value or less for the predetermined time and thereafter, exceeds the predetermined value, and the displacement of the hydraulic pump is reduced to the predetermined displacement which is smaller than the maximum. Since the hydraulic pressure in the bottom side of the cylinder is always in the state at the predetermined pressure or lower for the predetermined time before the excavating operation starts, and the hydraulic pressure obviously differs during excavating operation and non-excavating operation, it can be reliably determined that the working vehicle is under excavating operation, and efficient reduction in loss of power can be performed. Since the displacement of the hydraulic pump does not reduce until the bucket is thrust into the target object, it does not happen that the operator feels incompatibility due to reduction in the operating speed.

The control method may further includes the steps of: determining that the excavating operation is finished when forward and reverse travel operating means of the working vehicle is switched to a neutral or reverse travel position from a forward travel position, on performing a control by reducing the displacement to the predetermined displacement; and stopping the control to reduce the displacement of the hydraulic pump to the predetermined displacement.

The control method may further includes the steps of: determining that the excavating operation is finished when the hydraulic pressure in the bottom side becomes a predetermined value or less within a first set time previously set from the time of determining the start of the excavation operation, on performing a control by reducing the displacement to the predetermined displacement; and stopping the control to reduce the displacement of the hydraulic pump to the predetermined displacement. According to this method, after it is determined that the excavating operation starts, when the hydraulic pressure in the bottom side of the cylinder becomes the predetermined value or less within the first set time, the excavating operation is not continued, and it is determined that the excavating operation is finished, and the pump displacement reducing control is stopped. Therefore, the displacement of the hydraulic pump is not reduced to the predetermined displacement at the time of non-excavating operation, and therefore, the operation efficiency is not reduced due to reduction in the speed of the working machine.

The control method may further include the steps of: determining that the excavating operation is finished when the hydraulic pressure in the bottom side becomes a predetermined value or less, and a hydraulic pressure state of the predetermined value or less continues for more than a second set time previously set from the time of determining the start of the excavating operation, on performing a control by reducing the displacement to the predetermined displacement; and stopping the control to reduce the displacement of the hydraulic pump to the predetermined displacement. According to this method, after it is determined that the excavating operation starts, when the hydraulic pressure in the bottom side of the cylinder becomes the predetermined value or less and this state continues for more than the second set time, and the pump displacement reducing control is stopped. Therefore, even if the pump displacement reducing control is started by, for example, an error signal, the error signal is determined in a short time, and the control to reduce the displacement of the hydraulic pump is stopped, thus making it possible to prevent reduction in the operation efficiency.

The control method may further include the steps of: determining that the excavating operation is finished when a height of a bucket of the working machine becomes a predetermined value or more, on performing a control by reducing the displacement to the predetermined displacement; and stopping the control to reduce the displacement of the hydraulic pump to the predetermined displacement. According to this method, when the cylinder is operated, the bucket is raised and scoops up the target object, and scoops more of the target object into the bucket during excavating operation, there is no fear that the rising speed of the bucket becomes fast and operability is reduced.

A first construction of an apparatus for controlling a hydraulic pump for a working machine of a working vehicle according to the present invention includes: in an apparatus for controlling a hydraulic pump for a working machine of a working vehicle having a cylinder for operating the working machine and a variable displacement hydraulic pump for supplying predetermined pressure oil to the cylinder; a bottom pressure detector for detecting a hydraulic pressure in a bottom side of at least one cylinder of the cylinder; a displacement control device for controlling a displacement of the variable displacement hydraulic pump; and a controller which inputs a detection value from the bottom pressure detector therein, determines that an excavating operation starts when a predetermined time elapses with the detection value at a predetermined value or less and thereafter, the detection value exceeds the predetermined value, and outputs a displacement control signal for reducing the displacement of the variable displacement hydraulic pump to a predetermined displacement that is smaller than a maximum displacement to the displacement control device.

According to the above construction, the displacement of the hydraulic pump is reduced to the predetermined displacement when the predetermined time elapses with the hydraulic pressure in the bottom side of the cylinder at the predetermined value or less and thereafter, the hydraulic pressure exceeds the predetermined value. Namely, since it is reliably detected that the working vehicle is under excavating operation, and the pump displacement can be reduced to the predetermined displacement, the working vehicle capable of effectively reducing loss of power and capable of efficiently operating can be obtained.

Further, in the control apparatus: the controller may input therein a detection signal from operation position detecting means for detecting an operation position of forward and reverse travel operating means provided at the working vehicle, and may stop transmission of the displacement control signal to the displacement control device when the operation position is switched to a neutral or reverse travel position from a forward travel position. According to this constitution, when the operation position of the forward and reverse travel operating means is in a neutral or reverse travel position, transmission of the displacement control signal for reducing the displacement of the hydraulic pump is stopped. Therefore, the point of time at which the excavating operation is finished can be reliably detected, and the pump displacement does not reduce during non-excavating operation. Accordingly, the working vehicle without a fear of reducing the working efficiency can be obtained.

In the control apparatus: the controller may determine that the excavating operation is finished when the detection value from the bottom pressure detector becomes the predetermined value or less within a first set time previously set, after determining that the excavation operation starts, and may stop transmission of the displacement control signal to the displacement control device. According to this constitution, when the detection value from the bottom pressure detector becomes the predetermined value or less within the first set time, it is determined that the excavating operation is finished, and transmission of the displacement control signal of the hydraulic pump is stopped. Therefore, the hydraulic pressure in the bottom side of the cylinder temporarily becomes the predetermined value or more, and when the hydraulic pressure reduces in a short time, the control to reduce the displacement of the hydraulic pump to the predetermined displacement can be stopped. Accordingly, the working vehicle without a fear of reducing operation efficiency can be obtained.

In the control apparatus: the controller may determine that the excavating operation is finished when the detection value from the bottom pressure detector becomes the predetermined value or less after determining that the excavation operation starts, and a state at the predetermined value or less continues for more than a second set time previously set, and may stop transmission of the displacement control signal to the displacement control device. According to this constitution, even if the pump displacement reduction control is started with the error signal, for example, the error signal can be determined in a short time, and the control to reduce the displacement of the hydraulic pump to the predetermined displacement can be stopped. Accordingly, the working vehicle without the fear of reducing the working efficiency can be obtained.

In the control apparatus: a bucket height detector for detecting a height of a bucket of the working machine may be included; and the controller may input therein the bucket height from the bucket height detector after determining that the excavation operation starts, may determine that the excavating operation is finished when the bucket height becomes a predetermined value or more, and may stop transmission of the displacement control signal to the displacement control device. According to this constitution, when the bucket is raised, scoops up the target object, and scoops more of the target object into the bucket during excavating operation, the pump displacement control is stopped when the bucket is at the predetermined height or more, and therefore the rising speed of the bucket becomes fast, thus eliminating the fear of reducing operability. Accordingly, the working vehicle without a fear of reducing the operation efficiency can be obtained.

A second constitution of an apparatus for controlling a hydraulic pump for a working machine of a working vehicle according to the present invention includes: in an apparatus for controlling a hydraulic pump for a working machine of a working vehicle having a cylinder for operating the working machine, a variable displacement hydraulic pump for supplying predetermined pressure oil to the cylinder, a control valve for controlling a flow rate of pressure oil supplied to predetermined cylinders in the cylinder and a working machine operating lever, a bottom pressure detector for detecting a hydraulic pressure in a bottom side of at least one cylinder of the predetermined cylinders; a displacement control device for controlling a displacement of the variable displacement hydraulic pump so that a load sensing differential pressure that is a differential pressure of a load pressure of the predetermined cylinders and a discharge pressure of the variable displacement hydraulic pump becomes constant; and a controller which inputs therein a detection value from the bottom pressure detector, determines that an excavating operation starts when a predetermined time elapses with the detection value at a predetermined value or less and thereafter, the detection value exceeds a predetermined value, and reduces a stroke of the control valve for a maximum stroke of the working machine operating lever to a smaller predetermined stroke than the maximum stroke.

According to the above constitution, when the predetermined time elapses with the hydraulic pressure in the bottom side of the cylinder at the predetermined value or less, and thereafter, the hydraulic pressure exceeds the predetermined value, the displacement of the hydraulic pump is reduced to the predetermined displacement. Namely, since it is reliably detected that the working vehicle is under excavating operation, and the pump displacement can be reduced to the predetermined displacement, a working vehicle capable of effectively reducing loss of power and capable of efficiently operated can be obtained. Since the pump displacement is reduced to the small predetermined displacement than the maximum displacement by the load sensing hydraulic pressure control, a required flow rate can be ensured irrespective of the load of the cylinder, and efficient operation can be performed.

BEST MODE FOR CARRYING OUT THE INVENTION

Hereinafter, preferred embodiments of a method and an apparatus for controlling a hydraulic pump for a working machine of a working vehicle according to the present invention will be described in detail with reference to the drawings.

Figure 1:
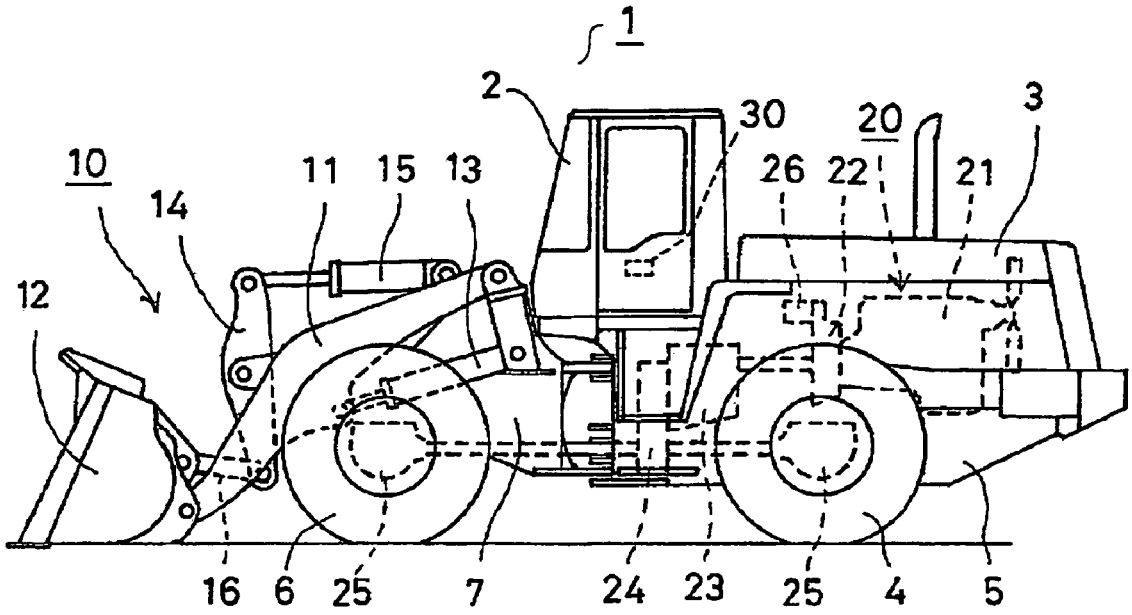
FIG. 1 is a side view of a wheel loader which is one example of a working vehicle having a control apparatus according to a first embodiment of the present invention.

A first embodiment will be explained below. FIG. 1 is a side view of a wheel loader which is one example of the working vehicle. In FIG. 1, a working vehicle 1 has a rear vehicle body 5 having a driver's cab 2, an engine frame 3 and rear wheels 4 and 4, and a front frame 7 having front wheels 6 and 6. A working machine 10 is mounted to the front frame 7. Namely, a bucket 12 is swingably mounted to a tip end portion of a lift arm 11 of which base end portion is swingably mounted to the front frame 7. The front frame 7 and the lift arm 11 are connected by a set of lift cylinders 13 and 13, and the lift arm 11 swings by extending and contracting the lift cylinders 13 and 13.

A substantially central portion of the tilt art 14 is swingably supported at the lift arm 11, and one end portion of the tilt arm 14 and the front frame 7 are connected by a tilt cylinder 15. The other end portion of the tilt arm 14 and the bucket 12 are connected by a tilt rod 16, and when the tilt cylinder 15 is extended and contracted, the bucket 12 swings. A power unit 20 is loaded on the rear vehicle body 5. The power unit 20 is constructed by an engine 21, a torque converter 22, a transmission 23 capable of switching forward and reverse travel and switching a plurality of speed gears, a distributor 24, speed reducers 25 and 25 for driving the rear wheel 4 and the front wheel 6 and the like. The engine 21 drives a variable displacement hydraulic pump 26 which supplies pressure oil to the lift cylinder 13 and the tilt cylinder 15. Forward and reverse travel operating means 30 is provided in the driver's cab 2. In this embodiment, a set of lift cylinders 13 and 13 and the tilt cylinder 15 construct a cylinder 60 for operating the working machine 10. However, the cylinder 60 is not limited to this, but the cylinder 60 may be an ordinary cylinder having the function of "operating the working machine of a working vehicle".

Next, one example of the process steps of excavating and loading operation of the wheel loader 1 will be explained.

(1) Forward traveling step: The operator operates the lift cylinder 13 and the tilt cylinder 15 to bring the bucket 12 into the excavating position, and operates the forward and reverse travel operating means 30 to move the vehicle forward to the target object to be excavated and loaded.

(2) Excavating step: The operator thrusts the blade edge of the bucket 12 into the target object, and operates the tilt cylinder 5 to tilt back the bucket 12 to scoop the target object into the buckets 12.

(3) Reverse traveling step: After scooping the target object into the bucket 12, the operator makes the vehicle 1 travel in the reverse direction.

(4) Forward traveling and boom raising step: While making the vehicle 1 travel forward, the operator extends the lift cylinder 13 to raise the lift arm 11, and while raising the bucket 12 up to the loading position, the operator makes the vehicle 1 approach the dump truck.

(5) Earth moving step: The operator makes the bucket 12 dump at a predetermined position and loads the target object into the rear deck of the dump truck.

(6) Reverse traveling and boom lowering step: The driver lowers the lift arm 11 while making the vehicle 1 travel in the reverse direction, and brings the bucket 12 into the excavating position.

Excavation and loading are performed by repeating the above described steps.

Figure 2:
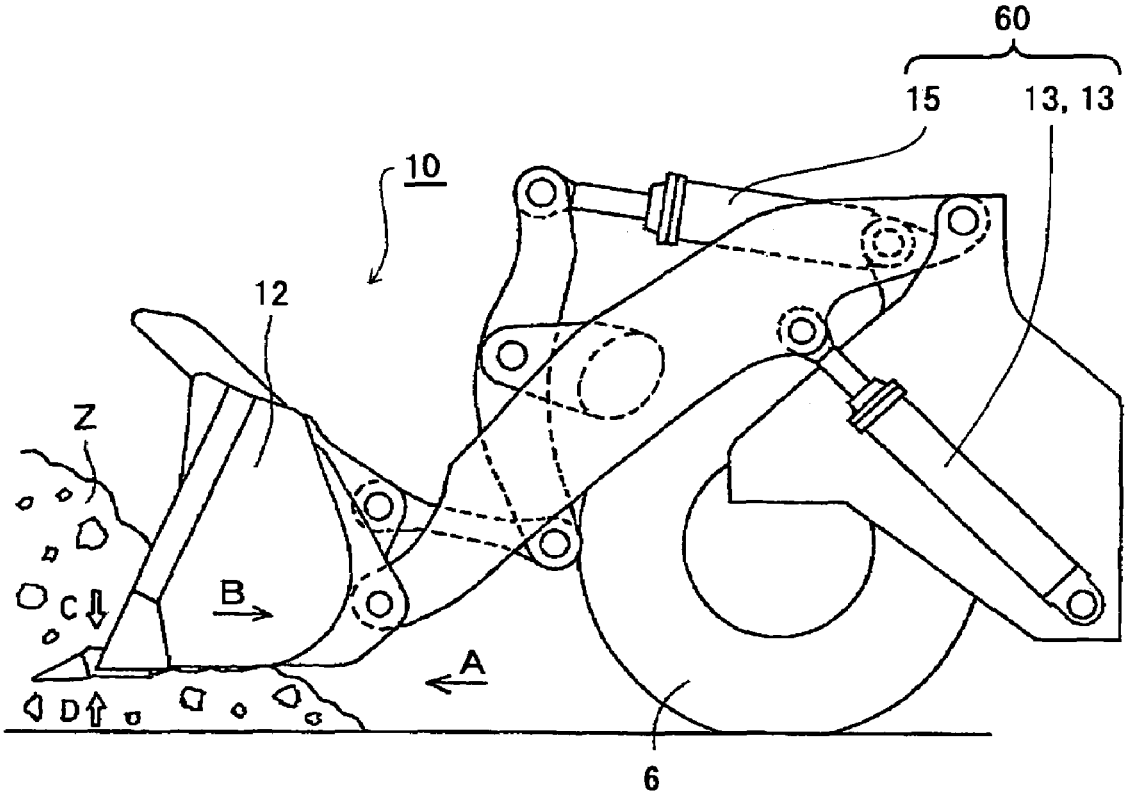
FIG. 2 is a side view of a working machine of the wheel loader in FIG. 1.

FIG. 2 is a side view showing a state of excavating with the bucket 12. The vehicle 1 is made to travel forward in the direction of the arrow A, the blade edge of the bucket 12 is thrust into a target object Z, and the blade 12 is tilted back, whereby, a force is applied to the bucket 12 in the directions of the arrows B and C. Therefore, a high hydraulic pressure occurs to the bottom sides of the lift cylinder 13 and the tilt cylinder 15. Depending on the operation posture, a force in the direction of the arrow D is applied to the bucket 12, and in this case, a high hydraulic pressure occurs to the head side of the tilt cylinder 15. The hydraulic pressures clearly differ at the time of excavating operation and at the time of non-excavating operation. Accordingly, the reference value of the lift cylinder bottom pressure is set, and it can be reliably determined whether it is under excavation operation or not. Since a high hydraulic pressure also occurs to the bottom side of the tilt cylinder 15, the reference value of the tilt cylinder bottom pressure is set, and it can be reliably determined whether it is under excavation operation or not.

Figure 3:
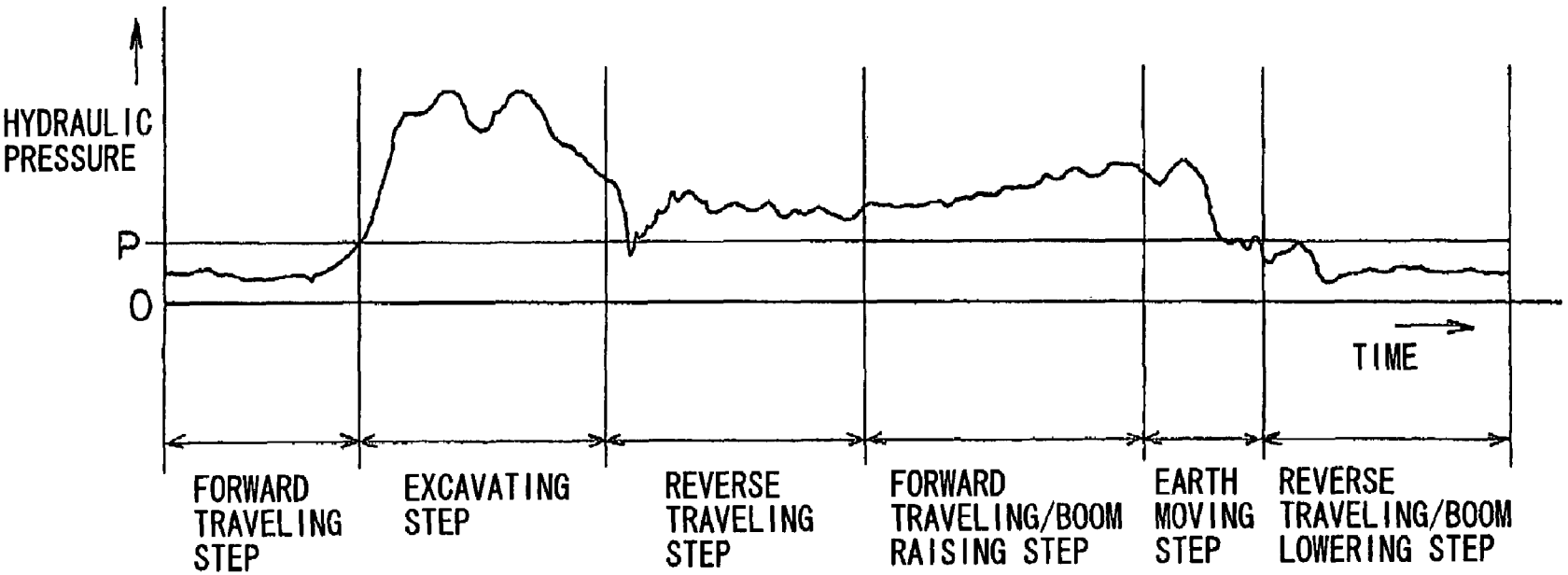
FIG. 3 is a graph showing one example of a change in a hydraulic pressure occurring to a bottom side of a lift cylinder in each step at a time of excavating and loading operation of the wheel loader in FIG. 1.

FIG. 3 is a graph showing an example of a change in the hydraulic pressure which occurs to the bottom side of the lift cylinder 13 at each step at the time of the excavating and loading operation of the wheel loader 1. The vertical axis in FIG. 3 is a hydraulic pressure at the bottom side of the lift cylinder 13, and the horizontal axis is time. As shown in FIG. 3, the bottom pressure of the lift cylinder 13 is low in the forward traveling step, becomes high in the excavating step, and becomes low when excavation is finished and the wheel loader 1 travels in the reverse direction. When a predetermined pressure P is set now, the bottom pressure of the lift cylinder 13 is lower than P in the entire range of the forward traveling step while it is very much higher than P in the entire range of the excavating step, and the difference is obvious. The bottom pressure of the lift cylinder 13 is higher than P in the reverse traveling step, forward traveling and boom raising step, the first half of the earth moving step, and thereafter, it is lower than P. The time of the forward traveling step always exists for several seconds (for example, five seconds). Accordingly, by detecting the point of time when the bottom pressure of the lift cylinder 13 becomes higher than P after it is lower than the predetermined pressure P for a predetermined time (for example, one second), the excavating operation starting point of time can be reliably detected. It is the most efficient to set the time when the forward and reverse travel operating means 30 is switched to the reverse travel as the end of excavating operation and perform the displacement reducing control of the hydraulic pump in the excavating step between the excavating operation starting point and the excavating operation end point.

Figure 4:
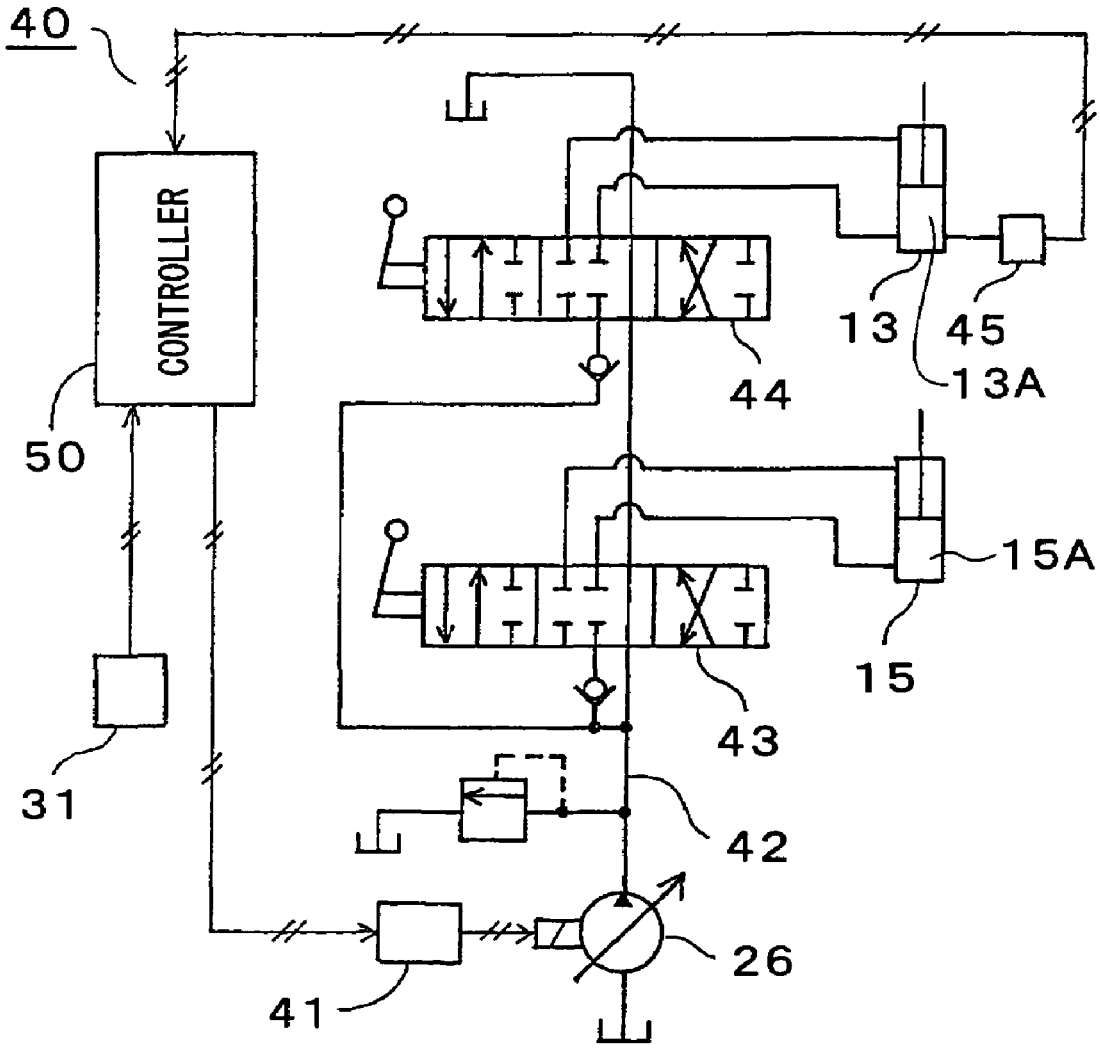
FIG. 4 is a system diagram of the control apparatus of the first embodiment.

The method and the apparatus for controlling the hydraulic pump will be explained hereinafter. FIG. 4 is a system diagram showing one example of a control apparatus 40. In FIG. 4, a capacity control device 41 is connected to the variable displacement hydraulic pump 26. A tilt operation valve 43 connecting to the tilt cylinder 15 and a lift operation valve 44 connecting to the lift cylinder 13 are interposed on a discharge circuit 42 of the variable displacement hydraulic pump 26. A bottom pressure detector 45 is provided at a bottom side 13A of the lift cylinder 13. The bottom pressure detector 45 is, for example, a pressure switch. The capacity control device 41 and the bottom pressure detector 45 are respectively connected to a controller 50. The controller 50 is connected to operation position detecting means 31 for detecting the operation position of the forward and reverse travel operating means 30, and detects whether the transmission 23 is in the forward, neutral or reverse position.

Next, the control method will be explained based on a flow chart in FIG. 5. After starting operation, the controller 50 inputs the detection result from the bottom pressure detector 45 and determines whether the lift cylinder bottom pressure is the predetermined pressure P or lower, or not in step 101. In the case of NO in step 101, the flow returns to the previous step to step 101. In the case of YES in step 101, the flow goes to step 102, and the controller 50 starts time measurement. In step 103, the controller 50 determines whether the state in which the lift cylinder bottom pressure is the predetermined pressure P or lower lasts for a predetermined time (for example, one second) or more, or not. In the case of NO in step 103, the flow returns to the previous step to step 103. In the case of YES in step 103, the flow goes to step 104, and the controller 50 determines whether the lift cylinder bottom pressure exceeds the predetermined pressure P or not. In the case of NO in step 104, the flow returns to the previous step to step 104. In the case of YES in step 104, the flow goes to step 105, and the controller 50 determines that the excavating operation starts.

In step 106, the controller 50 sets a predetermined displacement Q which is reducing from the maximum displacement Qmax of the variable displacement hydraulic pump 26 as $Q=\alpha*Qmax$. Here, $\alpha$ may be a coefficient determined corresponding to the magnitude of the travel drive force and hydraulic force when the wheel loader 1 operates, for example, or may be a coefficient determined in accordance with the soil property or the like (the kinds such as earth, rock and stone and the like, density, viscosity) of the site where the wheel loader 1 operates, and $\alpha$ is ordinarily 0.5 to 0.9. Accordingly, when, for example, $\alpha$ is 0.7, the predetermined displacement Q is set at the displacement which is 0.7 times as large as the maximum displacement Qmax. In step 107, the controller 50 outputs a control signal to the displacement control device 41 and the displacement of the variable displacement hydraulic pump 26 is reduced to the predetermined displacement. At the point of time when the excavating operation is finished, the operator operates the forward and reverse travel operating means 30 and changes the transmission 23 to the neutral or the reverse travel in step 108.

In step 109, the controller 50 inputs therein a detection signal from the operation position detecting means 31, and determines whether the transmission 23 is in the neutral or the reverse travel position. In the case of NO in step 109, the flow returns to the previous step to step 108. In the case of YES in step 109, the flow goes to step 110, the controller 50 determines the excavating operation is finished and the flow goes to step 111. In step 111, the controller 50 stops the pump displacement control and returns the displacement of the variable displacement hydraulic pump 26 to the state before control.

After the controller 50 determines that the excavating operation starts in step 105, it starts time measurement in step 112. In step 113, the controller 50 determines whether the time in which the lift cylinder bottom pressure exceeds the predetermined pressure P exceeds the first set time (for example, one second) previously set or not. Steps 112 and 113 are carried out in parallel with steps 106 and 107. In the case of NO in step 113, the controller 50 determines that the excavating operation is not continued, then proceeds to step 110 and determines that the excavating operation is finished. In the case of YES in step 113, the controller 50 determines that the excavating operation is continued, and proceeds to step 108. During this time, the hydraulic pump displacement reducing control is performed.

After the controller 50 determines that the excavating operation starts in step 105, it determines whether the lift cylinder bottom pressure becomes lower than the predetermined pressure P or not in step 114. In the case of NO in step 114, the flow returns to the previous step to step 114. In the case of YES in step 114, the controller 50 starts time measurement in step 115. In step 116, the controller 50 determines whether the time in which the lift cylinder bottom pressure is lower than the predetermined pressure P lasts for second set time previously set (for example, 0.5 seconds) or more, or not. Steps 114 to 116 are carried out in parallel with steps 106 and 107. In the case of NO in step 116, the flow returns to the previous step to step 116. In the case of YES in step 116, the controller 50 determines that it is not under excavating operation, then proceeds to step 110, and determines that the excavating operation is finished.

In the above described explanation, the bottom pressure detector 45 is provided at the bottom side 13A of the lift cylinder 13, and when the hydraulic pressure in the bottom side 13A of the lift cylinder 13 is the predetermined value or lower for the predetermined time and thereafter, the hydraulic pressure exceeds the predetermined value, it is determined that the working vehicle starts the excavating operation, then the displacement of the pump is reduced to the predetermined displacement which is smaller than the maximum displacement, but the present invention is not limited to this. For example, the bottom pressure detector is provided at the bottom side 15A of the tilt cylinder 15, and when the hydraulic pressure of the bottom side 15A of the tilt cylinder 15 is the predetermined value or lower for the predetermined time and thereafter, exceeds the predetermined value, it is determined that the working vehicle starts the excavating operation, then the displacement of the pump may be reduced to the predetermined displacement which is smaller than the maximum displacement. According to this, it goes without saying that the same operation and effect can be obtained.

Figure 6:
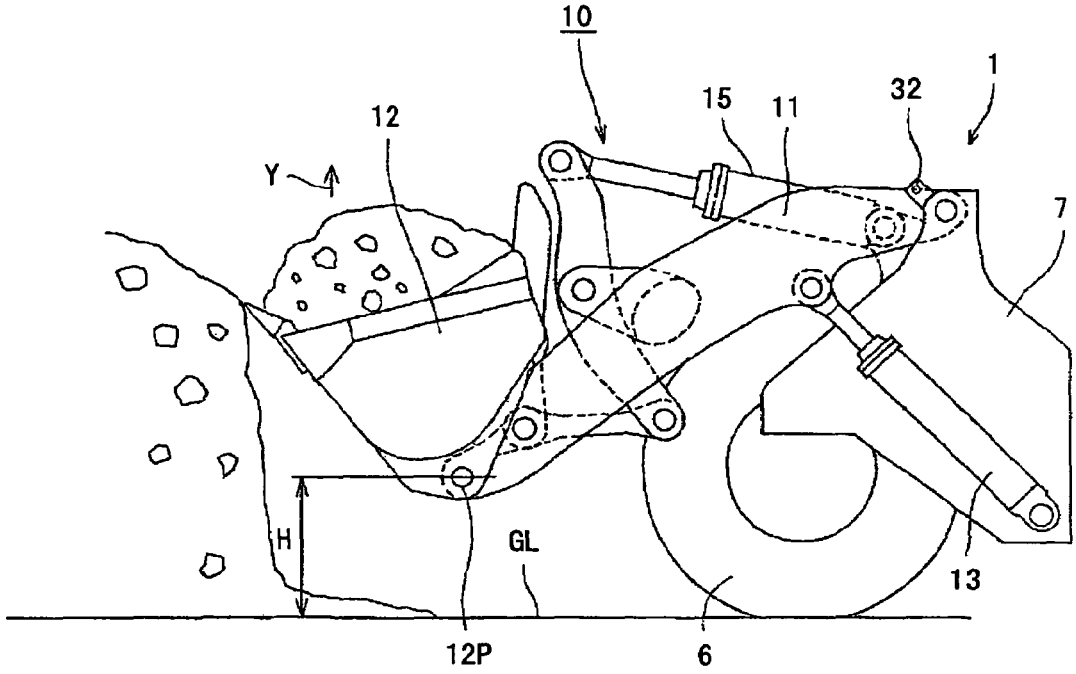
FIG. 6 is a side view of a front part of a wheel loader according to a second embodiment of the present invention.
Figure 7:
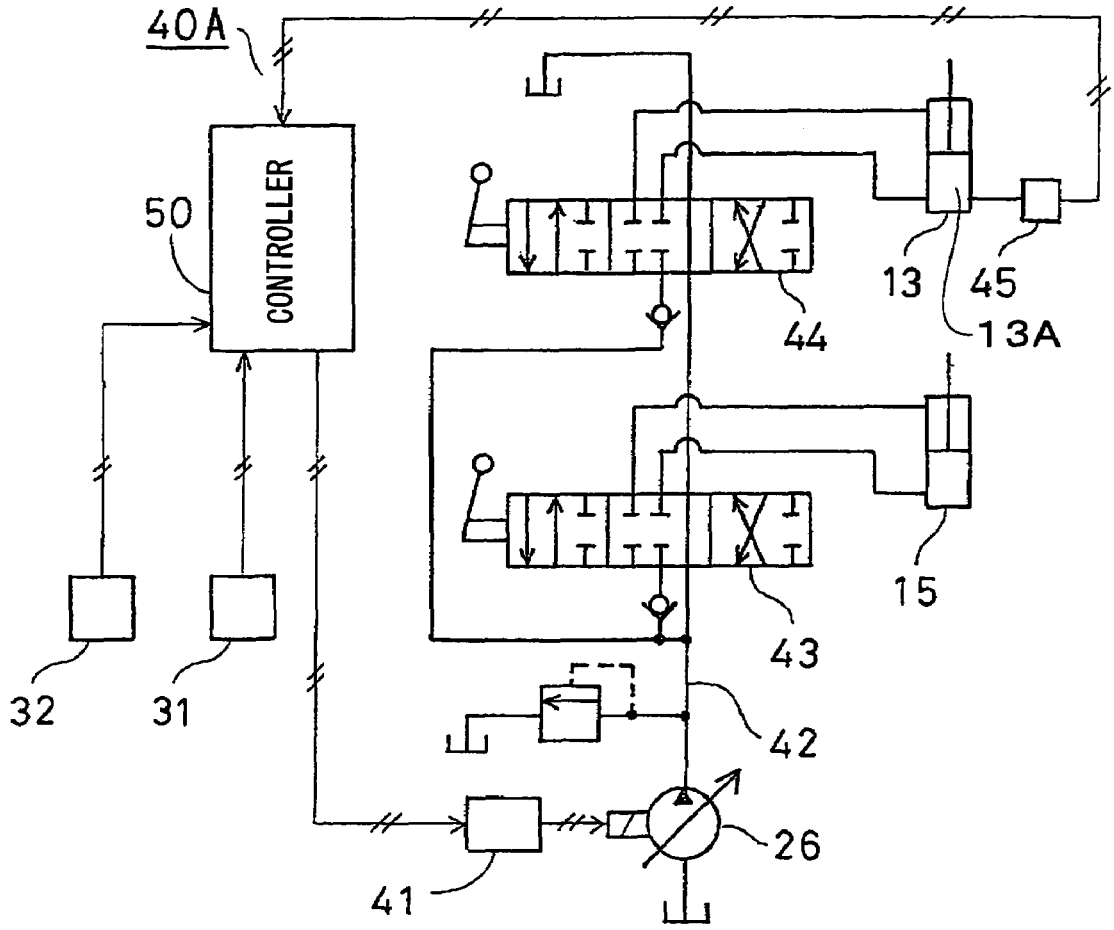
FIG. 7 is a system diagram of a control apparatus of the second embodiment.
Figure 8:
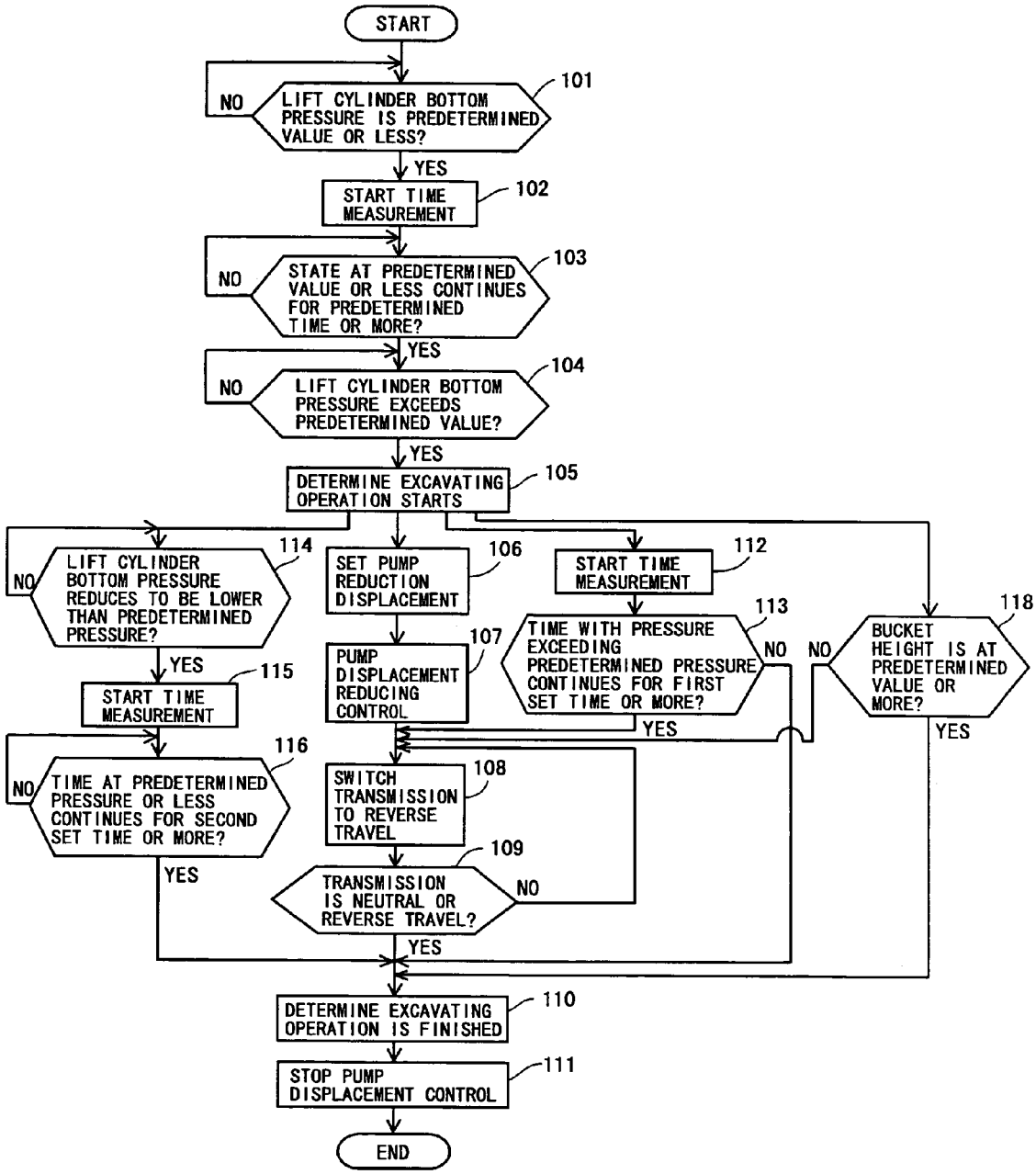
FIG. 8 is a flow chart for explaining a control method of the second embodiment.

Next, a second embodiment of the method and apparatus for controlling a hydraulic pump for a working machine of a working vehicle according to the present invention will be described in detail with reference to FIGS. 6 to 8. FIG. 6 differs from FIG. 1 in the respect that a bucket height detector 32 is included in the wheel loader 1. FIG. 7 is a system diagram showing one example of a control apparatus 40A. The control apparatus 40A differs from the control apparatus 40 in FIG. 4 in the respect that the control apparatus 40A includes the bucket height detector 32. FIG. 8 differs from FIG. 5 in the respect that step 118 is added. Accordingly, in the explanation in FIGS. 6 to 8, the same reference numerals and characters are given to the same portions as explained in FIGS. 1 to 5, and the explanation of them will be omitted.

As shown in FIG. 6, the front frame 7 includes the bucket height detector 32 for detecting the position of the top surface of the base end portion of the lift arm 11 with respect to the front frame 7. The bucket 12 is swingably mounted to the tip end portion of the lift arm 11 of which base end portion swingably mounted to the front frame 7 with a bucket hinge pin 12P. When a height H of the center of the bucket hinge pin 12P from a ground surface GL becomes a predetermined height, for example, 1.5 m, a signal is issued from the bucket height detector 32. Namely, when the height of the bucket 12 of the working machine 10 is the predetermined value or higher, the bucket height detector 32 issues the signal. The bucket height detector 32 is, for example, a proximity sensor, which issues an electrical signal when the top surface of the base end portion of the lift arm 11 comes within the predetermined distance from the proximity sensor. As shown in FIG. 7, the bucket height detector 32 is connected to the controller 50. The controller 50 receives the signal from the bucket height detector 32 and determines whether the bucket 12 is at the predetermined height or higher, or not as will be described later.

When the blade edge of the bucket 12 is thrust into the target object, the bucket 12 is tilted back by operating the tilt cylinder 15 to scoop the target object into the bucket 12 in the excavating step as shown in FIG. 6, the bucket 12 is sometimes raised in the direction of the arrow Y, scoops the target object and scoops more of the target object into the bucket 12, by operating the lift cylinder 13. In this case, if the displacement control of the hydraulic pump is kept performed, the extending speed of the lift cylinder 13 is low because the discharge amount of the hydraulic pump is small, and therefore, the rising speed of the bucket 12 is low, thus reducing the efficiency of the operation. Therefore, when the bucket 12 is at the predetermined height, the displacement control of the hydraulic pump is stopped to enhance the rising speed of the bucket 12 in this embodiment.

Next, the control method of this embodiment will be explained based on a flow chart in FIG. 8. After determining that the excavating operation starts in step 105, the controller 50 determines whether the height of the bucket 12 is at the predetermined value or more, or not by the signal from the bucket height detector 32 in step 118. Step 118 is carried out in parallel with steps 106 and 107. In the case of YES in step 118, the controller 50 determines that the excavating operation is not continued, proceeds to step 110 and determines that the excavating operation is finished, then proceeds to step 111. In the case of NO in step 118, the controller 50 determines that the excavating operation is continued, and proceeds to step 108. During this time, the hydraulic pump displacement reducing control is carried out.

As described above, according to the second embodiment, the bucket 12 is raised, scoops up the target object and scoops more of the target object into the bucket 12, by operating the lift cylinder 13 during an excavating operation. When the bucket 12 is at the predetermined height or more, the displacement control of the pump is stopped, and therefore, the rising speed of the bucket 12 becomes high, thus eliminating the fear of reducing operability. In this embodiment, a proximity sensor is used as the bucket height detector 32 as one example, but the bucket height detector 32 is not limited to this. For example, the height of the bucket hinge pin 12P of the bucket 12 may be detected by detecting the angle of the lift arm 11. Further, the height of the bucket hinge pin 12P of the bucket 12 may be detected by detecting the stroke of the lift cylinder 13.

Figure 9:
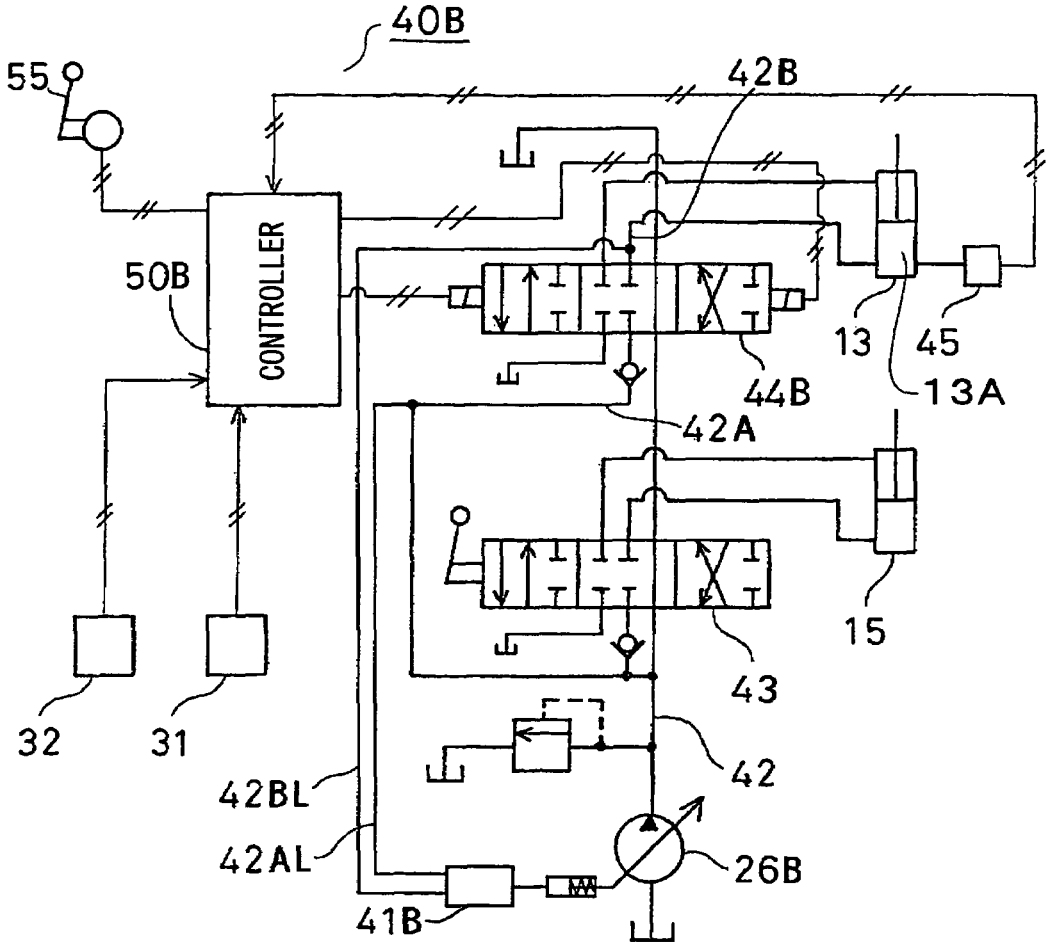
FIG. 9 is a system diagram of a control apparatus according to a third embodiment of the present invention.

Next, a third embodiment 3 of the apparatus for controlling the hydraulic pump for the working machine of the working vehicle according to the present invention will be described in detail with reference to FIGS. 9 to 12. FIG. 9 is a system diagram showing one example of a control apparatus 40B. In the explanation of the control apparatus 40B, the same parts as in the control apparatus 40 explained in FIG. 4 and the control apparatus 40A explained in FIG. 7 are given the same reference numerals and characters and the explanation of them will be omitted. In FIG. 9, a displacement control device 41B is connected to a variable displacement hydraulic pump 26B in FIG. 9. The tilt operating valve 43 which is connected to the tilt cylinder 15 and a lift operating valve 44B which is connected to the lift cylinder 13 are interposed on the discharge circuit 42 of the variable displacement hydraulic pump 26B. The lift operating valve 44B is an electromagnetic proportional control valve, which is connected to a controller 50B and is operated in accordance with the magnitude of the lift operating valve signal from the controller 50B.

A lift cylinder operating lever 55 which is a working machine operating lever is connected to the controller 50B, and when the operator operates the lift cylinder operating lever 55, the lift cylinder operating signal is transmitted to the controller 50B. The controller 50B outputs a lift operating signal to the lift operating valve 44B in accordance with the lift cylinder operating signal from the lift cylinder operating lever 55, and the controller 50B outputs the lift operating valve signal by changing the output value of an electric command value i of the lift operating valve signal at the normal time and at the excavating operation time.

A load sensing circuit 42AL for detecting the discharge pressure of the variable displacement hydraulic pump 26B branches from a discharge circuit 42A of the variable displacement hydraulic pump 26B, and the load sensing circuit 42AL connects to the displacement control device 41B. An outlet pressure detecting circuit 42BL of the lift operating valve 44B branches from an outlet circuit 42B of the lift control valve 44B, and the outlet pressure detecting circuit 42BL connects to the displacement control device 41B. By this constitution, a load sensing hydraulic pressure control is performed. Thereby, the displacement control device 41B performs so-called load sensing control for controlling a displacement of the variable displacement hydraulic pump 26B so that load sensing differential pressure ΔP which is the differential pressure between the discharge pressure of the variable displacement hydraulic pump 26B and the outlet pressure (load pressure of the lift cylinder 13) of the lift operating valve 44B becomes constant. Accordingly, irrespective of the magnitude of the load pressure of the lift cylinder 13, the flow rate in accordance with the opening area of the lift operating valve 44B can be ensured, and the efficient operation can be performed.

Figure 10:
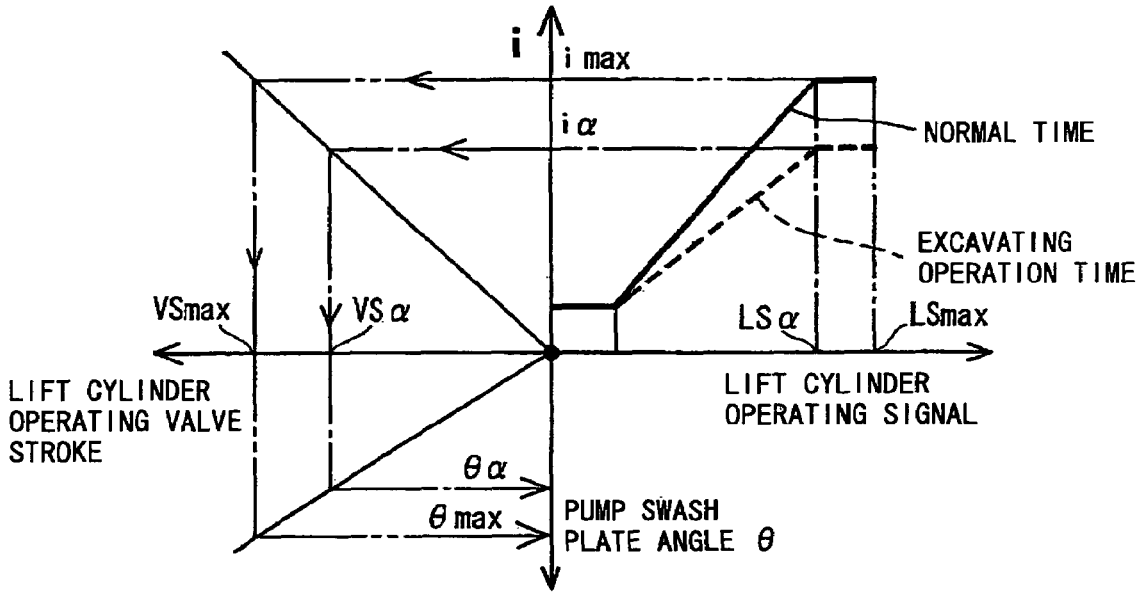
FIG. 10 is a graph for explaining a control method of the third embodiment.

Next, an operation of this embodiment will be explained. The control content of this embodiment is the same as the control flows in FIGS. 5 and 8, but the methods of setting the pump reduction displacement in step 106 are different. When the operator operates the lift cylinder operating lever 55 at the normal time when it is not determined the excavating operation starts, the electric command value i of the lift operating valve signal from the controller 50B with respect to the lift cylinder operating signal (stroke of the lift cylinder operating lever 55) changes as the solid line as shown in FIG. 10. Namely, at the maximum value LSmax of the lift cylinder operating signal where the stroke of the lift cylinder operating lever 55 becomes maximum, the electric command value i becomes imax. When the electric command value i becomes imax, the stroke of the lift operating valve 44B becomes VSmax. Then, the opening area of the lift operating valve 44B becomes maximum, and the pump swash plate angle θ is set as θmax so that the load sensing differential pressure ΔP in this state becomes a predetermined fixed value to control the pump displacement of the variable displacement hydraulic pump 26B to be Qmax which is the maximum displacement.

Figure 5:
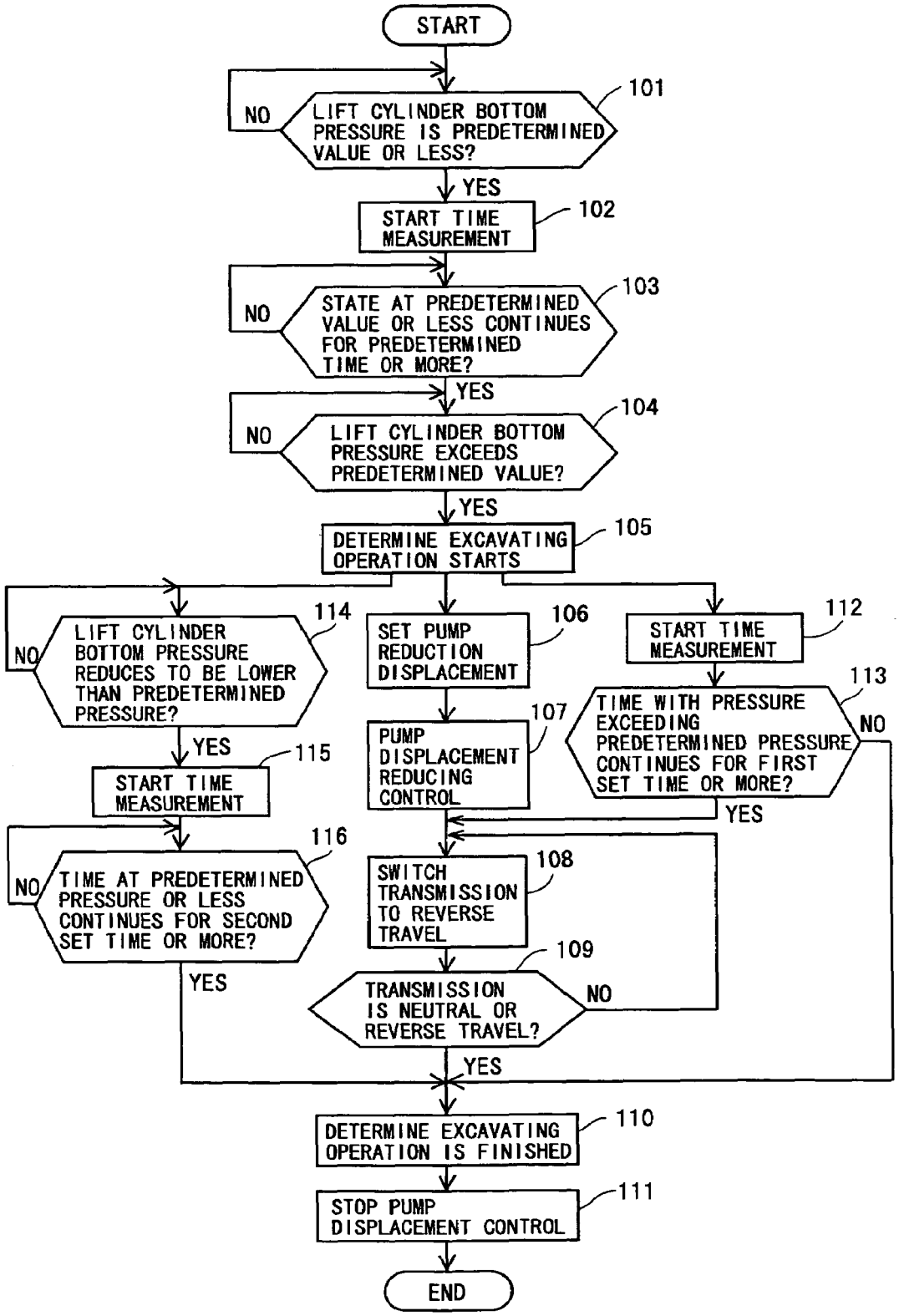
FIG. 5 is a flow chart for explaining a control method of the first embodiment.

When the controller 50B proceeds to step 105 in FIG. 5 and determines that excavating operation starts, the flow goes to step 106, and the controller 50B sets the pump reduction displacement. Namely, when the operator operates the lift cylinder operating lever 55 in the state in which the excavating operation starts, the electric command value i changes as the broken line as shown in FIG. 10. Namely, at the maximum value LSmax of the lift cylinder operating signal, the electric command value i becomes the reduced value iα (for example, 0.7 times as large as imax), and the stroke of the lift operating valve 44B becomes the reduced stroke VSα (for example, 0.7 times as large as VSmax).

As a result, even if the stroke of the lift cylinder operating lever 55 is the maximum, the opening area of the lift operating valve 44B becomes the reduced opening area to be smaller than the maximum value. As a result, the displacement control apparatus 41B operates so that the load sensing differential pressure ΔP becomes a predetermined fixed value, and the control is carried out so that the pump swash plate angle θ becomes the reduced pump swash plate angle θα to be smaller than θmax. As a result, the pump displacement of the variable displacement hydraulic pump 26B becomes the reduced Qα to be smaller than the maximum displacement Qmax. In this manner, the control device 40B sets the displacement of the variable displacement hydraulic pump 26B as a reduced predetermined displacement Q to be smaller than the maximum displacement Qmax, namely Q=α*Qmax (=Qα).

When determining that the excavating operation is finished and proceeding to step 111, the controller 50B returns the electric command value i to the lift operating valve 44B to the pattern changing as the solid line (at the normal time). As a result, at the maximum (maximum value LSmax) of the stroke of the lift cylinder operating lever 55, the electric command value i becomes imax. Since the stroke of the lift operating valve 44B becomes VSmax as a result, the opening area of the lift operating valve 44B becomes the maximum value, and the displacement control device 41B operates so that the load sensing differential pressure ΔP becomes a fixed value, and carries out the control so that the pump swash plate angle θ becomes θmax. Thereby, the pump displacement control is stopped, and the displacement of the variable displacement hydraulic pump 26B returns to the state before control.

This embodiment is the same as the first embodiment and the second embodiment in the following respects: i) the displacement control of the pump is stopped when the operator brings the forward and reverse travel operating means into the neutral or reverse travel position after the excavating operation is finished, ii) the pump displacement reducing control is stopped by determining that the excavating operation is not continued when the hydraulic pressure at the bottom side of the lift cylinder becomes the predetermined value or lower within the first set time previously set after it is determined that the excavating operation is started, iii) the pump displacement reduction control is stopped by determining that the excavating operation is finished when the hydraulic pressure at the bottom side of the lift cylinder becomes the predetermined value or lower and this state exceeds the second set time previously set, after it is determined that the excavation is started, iv) the displacement control of the pump is stopped when the bucket 12 is at a predetermined height or higher when the bucket 12 is raised, scoops up the target object and scoops more of the target object into the bucket 12, by operating the lift cylinder 13 during the excavating operation. The control contents of this embodiment other than the above are the same as in the embodiment 1 and embodiment 2, and therefore, the explanation will be omitted. According to this embodiment as described above, the same effect as the embodiment 1 can be also obtained.

Figure 11:
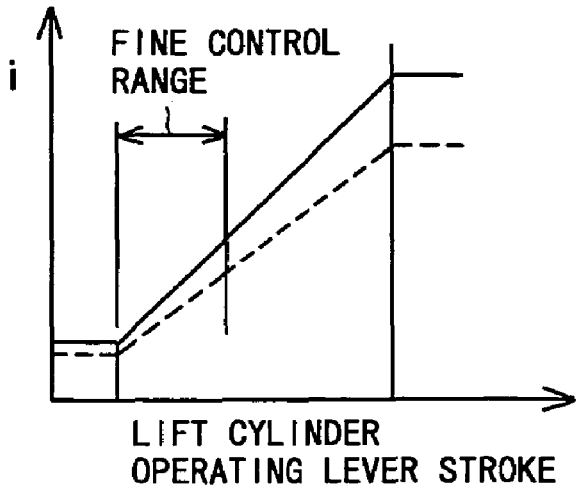
FIG. 11 is a graph for explaining a modification example of the control method of the third embodiment.

FIG. 11 shows the case where the electric command value i of the lift operating valve signal for the stroke of the lift cylinder operating lever 55 is in the pattern as the solid line (the normal time) and in the pattern as the broken line (excavating operation time). In this case, the maximum displacement of the variable displacement hydraulic pump 26B is reduced, responsiveness in the intermediate range of the stroke of the lift cylinder operating lever 55 is made low to make the responsiveness in the fine control range dull, and fine control of the lift cylinder 13 can be facilitated.

Figure 12:
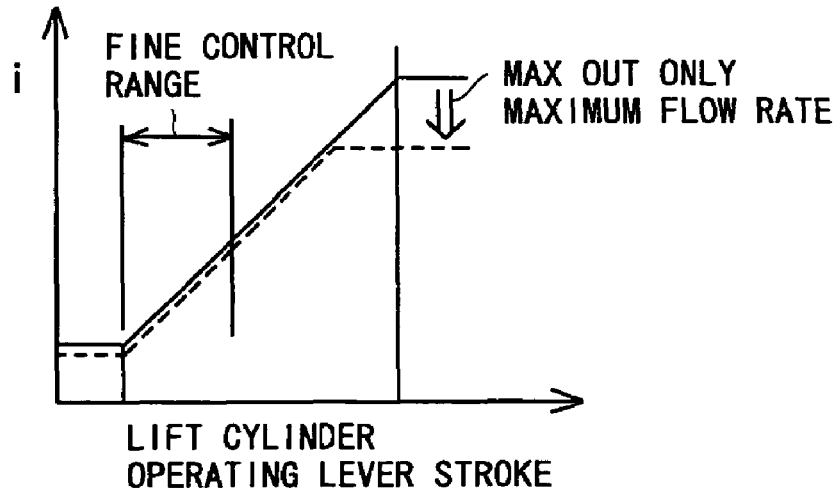
FIG. 12 is a graph for explaining another modification example of the control method of the third embodiment.
Figure 13:
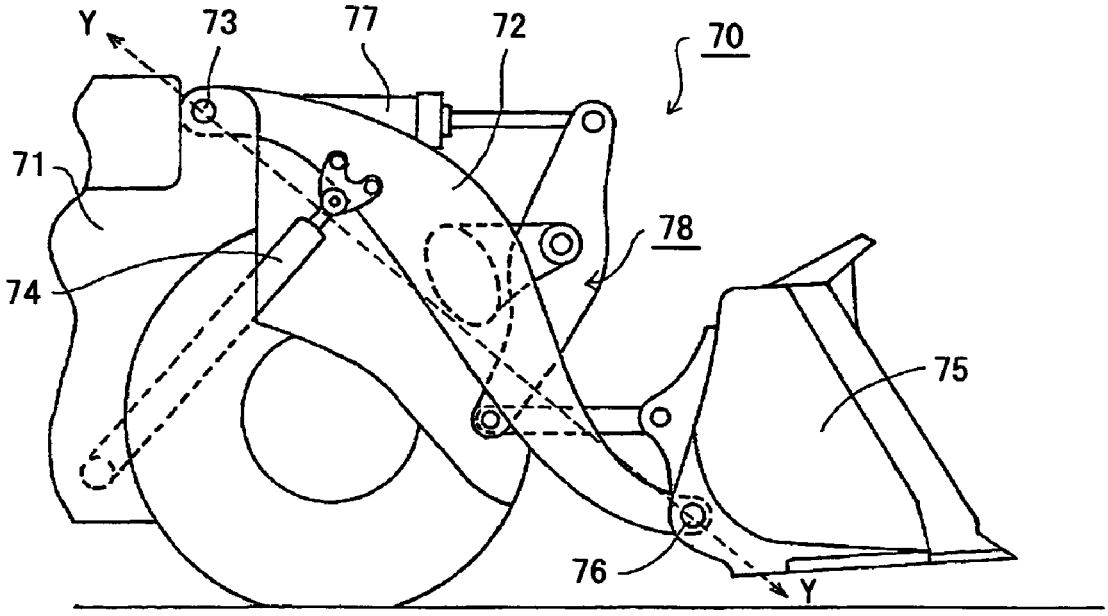
FIG. 13 is a side view showing an excavating position of a working machine of a conventional working vehicle.

FIG. 12 shows the case where the maximum value of the electric command value i of the lift operating valve signal for the stroke of the lift cylinder operating lever 55 is maxed out at the time of excavating operation. In this case, only the maximum displacement of the variable displacement hydraulic pump 26B is reduced, and the responsiveness in the intermediate range of the stroke of the lift cylinder operating lever 55 is not changed, so that it is made possible that the responsiveness in the intermediate range of the stroke of the lift cylinder operating lever 55 does not change. As a result, a change is not made in the responsiveness in the fine control range, so that it is made possible that the speed at which the lift cylinder 13 moves does not change, and incompatibility does not occur to the operator.

INDUSTRIAL AVAILABILITY

The present invention is useful as a method and apparatus for controlling a hydraulic pump for a working machine of a working vehicle which is capable of reducing power loss by reliably detecting that the working vehicle is under excavating operation, and which does not reduce working efficiency or gives a sense of incompatibility to the operator.

The invention claimed is:

1. An apparatus for controlling a hydraulic pump for a working machine of a working vehicle having a cylinder arrangement for operating the working machine, a variable displacement hydraulic pump for supplying oil at a specified pressure to said cylinder arrangement, a control valve for controlling a flow rate of oil supplied to predetermined cylinders in said cylinder arrangement and a working machine operating lever, comprising:

a bottom pressure detector for detecting a hydraulic pressure in a bottom side of at least one cylinder of said predetermined cylinders in said cylinder arrangement;

a displacement control device for controlling a displacement of said variable displacement hydraulic pump so that a load sensing differential pressure that is differential pressure of a load pressure of said predetermined cylinders and a discharge pressure of said variable displacement hydraulic pump becomes constant; and a controller which inputs therein a detection value from said bottom pressure detector, determines that an excavating operation starts when a predetermined time elapses with said detection value at a predetermined value or less and thereafter, said detection value exceeds a predetermined value, and reduces a stroke of said control valve for a maximum stroke of said working machine operating lever to be a smaller predetermined stroke than a maximum stroke.

2. The apparatus for controlling the hydraulic pump for the working machine of the working vehicle according to claim 1, wherein said controller inputs therein a detection signal from an operation position detecting means for detecting an operation position of a forward and reverse travel operating unit of said working vehicle, and stops transmission of said displacement control signal to said displacement control device when the operation position is switched to a neutral or reverse travel position from a forward travel position.

3. The apparatus for controlling the hydraulic pump for the working machine of the working vehicle according to claim 1, wherein said controller determines that the excavating operation is finished when said detection value from said bottom pressure detector becomes the predetermined value or less within a first set time previously set, after determining that the excavating operation starts, and stops transmission of said displacement control signal to said displacement control device.

4. The apparatus for controlling the hydraulic pump for the working machine of the working vehicle according to claim 1, wherein said controller determines that the excavating operation is finished when said detection value from said bottom pressure detector becomes the predetermined value or less, after determining that the excavating operation starts, and a state at the predetermined value or less continues for more than a second set time previously set, and stops transmission of said displacement control signal to said displacement control device.

5. The apparatus for controlling the hydraulic pump for the working machine of the working vehicle according to claim 1, further comprising:

a bucket height detector for detecting a height of a bucket of said working machine, wherein said controller inputs therein said bucket height from said bucket height detector after determining that the excavating operation starts, and determines that the excavating operation is finished when said bucket height becomes a predetermined value or more, and stops transmission of said displacement control signal to said displacement control device.

6. The apparatus for controlling the hydraulic pump for the working machine of the working vehicle according to claim 1, wherein said controller is arranged to measure a duration of time when said detection value is at the predetermined value or less.

7. The apparatus for controlling the hydraulic pump for the working machine of the working vehicle according to claim 1, wherein said controller is further arranged to output a displacement control signal for reducing the displacement of said variable displacement hydraulic pump to a predetermined displacement that is smaller than a maximum displacement of said variable displacement hydraulic pump to said displacement control device after said controller determines that the excavating operation has started.

8. A method for controlling a hydraulic pump of a working machine of a working vehicle having a cylinder arrangement for operating the working machine, a variable displacement hydraulic pump for supplying oil at a specified pressure to said cylinder arrangement, a control valve for controlling a flow rate of oil supplied to predetermined cylinders in said cylinder arrangement and a working machine operating lever, said method comprising:

detecting a hydraulic pressure in a bottom side of at least one cylinder of said predetermined cylinders in said cylinder arrangement;

controlling a displacement of said variable displacement hydraulic pump so that a load sensing differential pressure that is differential pressure of a load pressure of said predetermined cylinders and a discharge pressure of said variable displacement hydraulic pump becomes constant;

determining that an excavating operation starts when a predetermined time elapses with said detection value at a predetermined value or less and thereafter, said detection value exceeds a predetermined value; and then reducing a stroke of said control valve for a maximum stroke of said working machine operating lever to be a smaller predetermined stroke than a maximum stroke.

9. The method for controlling a hydraulic pump of a working machine of a working vehicle according to claim 8, further comprising:

determining that the excavating operation is finished when a forward and reverse travel operating unit of said working vehicle is switched to a neutral or reverse travel position from a forward travel position, after determining that the excavating operation starts; and then stopping control to reduce the stroke of said control valve to the smaller predetermined amount.

10. The method for controlling a hydraulic pump for a working machine of a working vehicle according to claim 8, further comprising:

determining that the excavating operation is finished when the hydraulic pressure in said bottom side becomes the predetermined value or less within a first set time previously set, after determining that the excavating operation starts; and then stopping control to reduce the stroke of said control valve to the smaller predetermined amount.

11. The method for controlling a hydraulic pump for a working machine of a working vehicle according to claim 8, further comprising:

determining that the excavating operation is finished when the hydraulic pressure in said bottom side becomes the predetermined value or less, after determining that the excavating operation starts, and a hydraulic pressure state of the predetermined value or less continues for more than a second set time previously set; and then stopping control to reduce the stroke of said control valve to the smaller predetermined amount.

12. The method for controlling a hydraulic pump for a working machine of a working vehicle according to claim 8, further comprising:

determining that the excavating operation is finished when a height of a bucket of said working machine becomes a predetermined value or more, after determining that the excavating operation starts; and then stopping control to reduce the stroke of said control valve to the smaller predetermined amount.

13. The method for controlling the hydraulic pump for the working machine of a working vehicle according to claim 8, further comprising:

measuring a duration of time of a state in which said hydraulic pressure in said bottom side is at the predetermined value or less.

* * * * *